United States Patent [19]

Kurtz

[11] Patent Number: 5,036,564

[45] Date of Patent: Aug. 6, 1991

[54] PRESS-ON TYPE FINGER PULLS

[76] Inventor: Thomas D. Kurtz, 1101 First Ave., Rock Falls, Ill. 61071

[21] Appl. No.: 612,224

[22] Filed: Nov. 13, 1990

[51] Int. Cl.[5] ..... A47B 95/02; E05B 1/00

[52] U.S. Cl. ..... 16/124

[58] Field of Search ..... 16/87 R, 110, 124; 49/413, 460; 312/139, 139.2, 320

[56] References Cited

U.S. PATENT DOCUMENTS

| | | | |
|---|---|---|---|
| 3,222,732 | 12/1965 | Miller | 16/110 R |
| 3,499,693 | 3/1970 | Whitehead | 16/110 R |
| 3,524,215 | 8/1970 | Kurtz | 16/124 |
| 4,548,846 | 10/1985 | Kurtz | 16/124 |

FOREIGN PATENT DOCUMENTS

| | | | |
|---|---|---|---|
| 1130809 | 10/1968 | United Kingdom | 10/110 R |

OTHER PUBLICATIONS

Pages from Kinkead Installation Instructions for Vista--Glide II (dated 1/87).

Two photographs of a "handle plate" for Vista-Glide II, mounted on a glass panel.

*Primary Examiner*—Robert L. Spruill

*Attorney, Agent, or Firm*—Vernon J. Pillote

[57] ABSTRACT

A press-on type finger pull for application to the face of sliding panels. The finger pull comprises a rigid body having a rear mounting surface and a front surface wider than the rear mounting surface and side surfaces that extend forwardly and outwardly from the rear mounting surface to form a narrow finger contact edge adjacent the front surface and a fingernail receiving recess rearwardly of the finger contact edge. Abutment ribs extend transverse to each side surface and have a rear face generally coplanar with the mounting surface and an abutment face extending transverse of the plane of the mounting surface between the rear face and the finger contact edge. A thin layer of pressure sensitive adhesive is provided on the rear mounting face for attaching the finger pull to a panel.

10 Claims, 1 Drawing Sheet

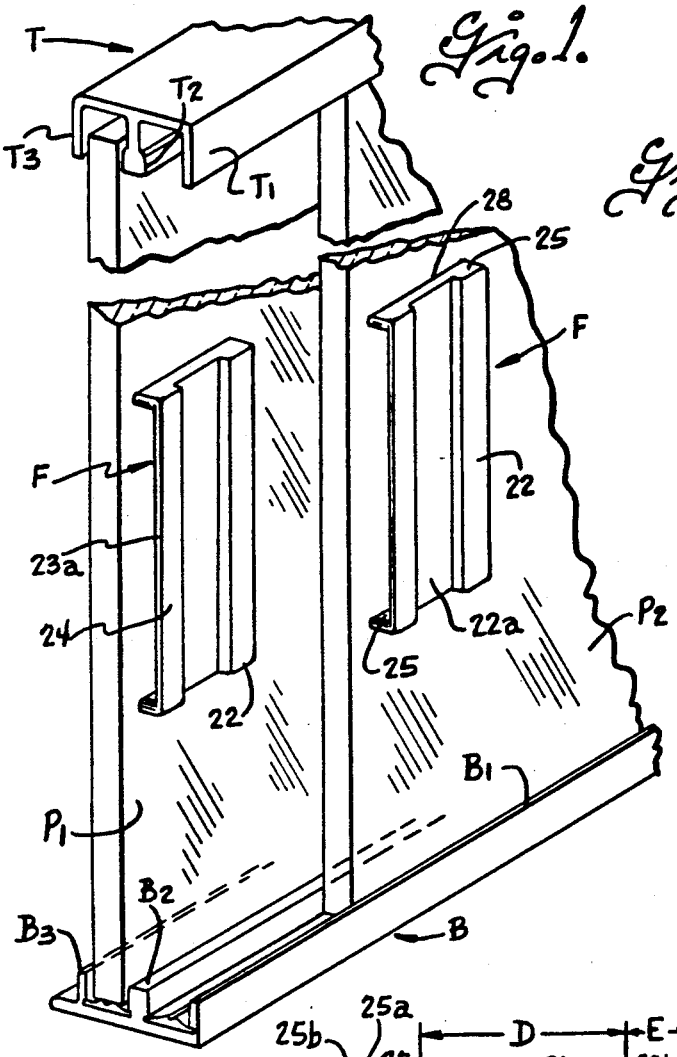
Fig. 1.
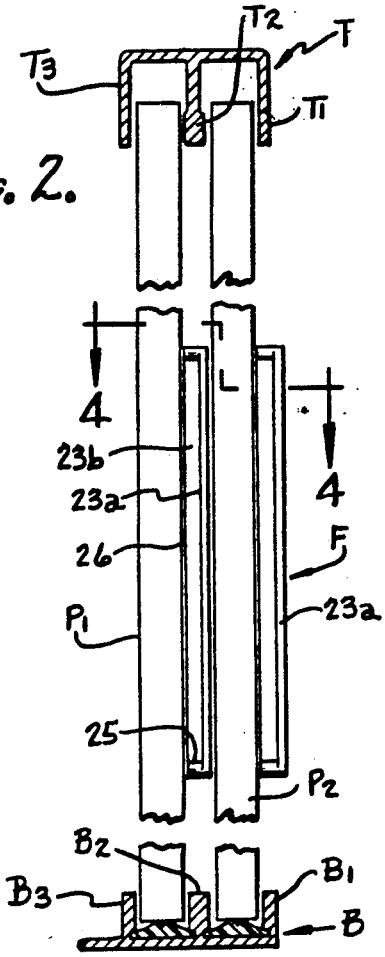
Fig. 2.
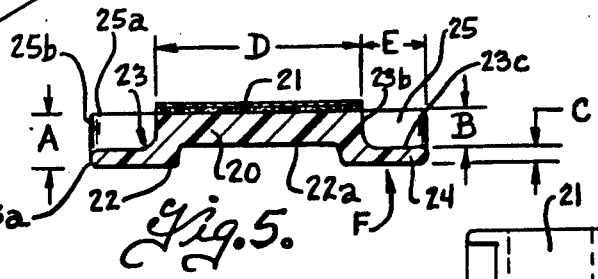
Fig. 5.
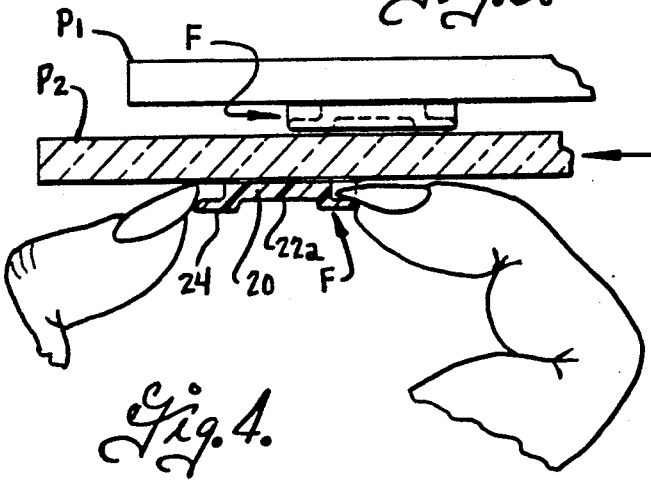
Fig. 4.
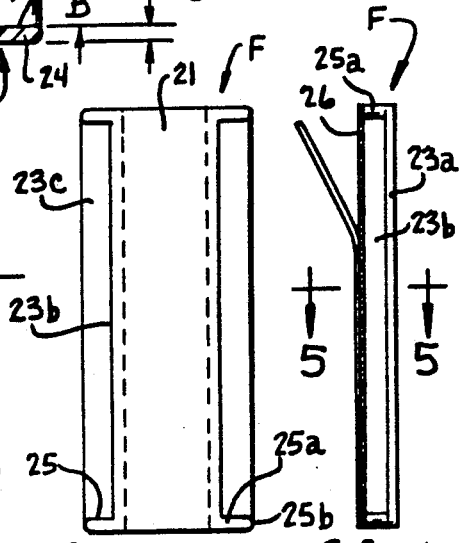
Fig. 6.
Fig. 3.

PRESS-ON TYPE FINGER PULLS

BACKGROUND OF THE INVENTION

The present invention relates to press-on finger pulls for sliding panels such as are used on showcases and the like. Such panels are slidably mounted on tracks which allow the panels to bypass each other during opening and closing and one type of track commonly used provides parallel channels that slidably receive the edges of the panels and which are separated by a narrow divider rib having a width of only about ⅛" 0.32 cm.). Although the channels have a width somewhat greater than the thickness of the panels, the working spacing between the faces of the panels is only slightly greater than the minimum spacing provided by the divider rib. In order to minimize interference with bypassing of the panels, finger pulls used on such panels should be relatively thin and not substantially greater than 5/32" 0.40 cm.).

U.S. Pat. No. 3,524,215 issued to the present applicant, discloses a finger pull having a flat rear mounting face, a layer of pressure sensitive adhesive on the rear mounting face for adhesively securing the finger pull on the surface of the panel, and a shallow finger receiving depression in the front face. The finger receiving depression extended only part way through the finger pull and the edges of the depression provided a shallow edge for engagement by the user's finger tips. Some users, particularly those with long finger nails, encountered problems with breakage of their finger nails when using the prior finger pulls.

SUMMARY OF THE INVENTION

Various objects of this invention are to provide an improved press-on type finger pull which has fingernail receiving recesses along opposite side edges of the finger pull; which is sufficiently thin to allow an outer panel to bypass the finger pull on an inner panel during opening and closing of the panels; which is arranged to minimize the likelihood of damage or breakage to a panel or to the finger pull in the event a panel contacts a side edge of the finger pull during opening or closing the panels.

Accordingly, the present invention provides a press-on type finger pull having a planar rear mounting surface and a front surface wider than the rear mounting surface and side surfaces that extend forwardly and outwardly from the rear mounting surface and define a narrow finger contact edge adjacent the front surface and a fingernail receiving recess rearwardly of the finger contact edge. At least one abutment rib extends transverse to each side surface and has a rear face generally coplanar with the mounting surface and an abutment face extending transverse of the plane of the mounting surface between the rear face and finger contact edge. A thin layer of pressure sensitive adhesive is provided on the rear mounting surface for securing the finger pull to the face of a sliding panel.

The abutment ribs reinforce the finger contact edge of the finger pull and are arranged to provide a stop face that extends transverse to the mounting surface to minimize likelihood of chipping or breakage of the edge of the panel in the event a panel engages the finger contact edge. In addition, the abutment ribs aid in stabilizing the finger pull when mounted on the panel, to inhibit separation of the finger pull due to forces applied to the finger pull by the user or due to forces applied to the pull in the event an edge of the finger pull is engaged by a panel.

BRIEF DESCRIPTION OF THE DRAWINGS

FIG. 1 is a fragmentary perspective view of bypassing type sliding panels with the finger pull of the present invention applied thereto;

FIG. 2 is a fragmentary end elevational view of the sliding panels with finger pulls applied thereto;

FIG. 3 is a side elevational view of the finger pull illustrating removal of the protective cover from the adhesive layer;

FIG. 4 is a fragmentary horizontal sectional view taken on the broken section line 4—4 of FIG. 2;

FIG. 5 is a transverse sectional view through the finger pull illustrating the finger pull on approximately two times full scale to illustrate details of construction; and FIG. 6 is a rear elevational view of the finger pull.

DETAILED DESCRIPTION

Reference is made to FIGS. 1 and 2 which illustrate two panels designated P1 and P2 which are slidably mounted in upper and lower trackways T and B respectively for movement along relatively parallel path into and out of a closed position. In the embodiment illustrated, the trackways T and B are of the type respectively having an outer flange T1, B1; an intermediate flange or rib T2, B2 and an inner flange T3, B3 that define parallel channels for slidably receiving the panels Pl and P2. The panels used in showcases and the like are commonly made of glass but are sometimes made of wood or composition board and the thickness of the panels used vary in different installations with a minimum thickness of about ⅛" (0.32 cm.) and a maximum thickness of about ¼" (0.63 cm.) or more. The dimensions of the trackways T and B also vary for different installations and with different manufacturers. However, it has been found that the channel-type trackways commonly have a center flange with a thickness of about ⅛" (0.32 cm.) thickness and that the spacing between the center flange and the outer and inner flanges is somewhat greater than the nominal thickness of the panels to be mounted in the tracks so that the working spaces between the panels is not limited to the minimum spacing determined by the thickness of the central flanges. In order to adapt the finger pull for use with panels and tracks of different thickness and spacing, while maximizing the ease and comfort of use of the finger pull, the finger pull is preferably made with a thickness slightly greater than the minimum panel spacing provided by the central flanges of the trackways and preferably a thickness of about 5/32" (0.64 cm.). It has been found that panels mounted in tracks with a ⅛" center flange or rib, will bypass such finger pulls in normal operation, but that the edge of the outer panel can, on occasion, engage or strike the edge of the finger pull on the inner panel.

Finger pulls F of the present invention are applied to the faces of the sliding panel. In the drawings, the finger pulls are shown applied to like ends of both the inner and outer panels, it being understood that it is common practice to mount the finger pulls adjacent relatively opposite ends of the inner and outer panels. Finger pulls can also be mounted on both ends of the inner and outer panels. The finger pulls include a central body portion 20 having a planar rear mounting surface 21 and flange portions 24 that extend in opposite directions from the central body portion. The front surface 22 of the finger pulls is wider than the rear mounting surface, and side surfaces 23 extend forwardly and outwardly from the rear mounting surface and each define a narrow finger contact edge 23*a* adjacent the front surface and a finger nail receiving recess rearwardly of the finger contact edge. Abutment ribs 25 are formed integrally with the body and extend transverse to each side surface adjacent opposite ends of the body. The abutment ribs each have a rear face 25*a* generally coplanar with the mounting surface and an abutment face 25*b* that extends transverse to the plane of the mounting surface between the rear face 25*a* and the finger contact edge 23*a*.

A thin layer of pressure sensitive adhesive 26 is applied to the rear mounting face and a sheet of peelable cover material 27 (FIG. 3) is provided on the side of the adhesive layer opposite the finger pull, to protect the rear face of the pressure sensitive adhesive prior to application to a panel. The layer of pressure sensitive adhesive is relatively thin and is preferably of the order of 5 mil to 10 mil thickness. The pressure sensitive adhesive 26 and the cover sheet 27 may, for example, be an adhesive transfer tape of the type sold by Minnesota Mining and Manufacturing Company, Minneapolis, Minn.

The planar mounting surface 26 can be a smooth flat surface as disclosed in U.S. Pat. No. 3,524,215 or may be embossed as disclosed more fully in the applicant's U.S. Pat. No. 4,548,846, in a pattern to define ridges separated by shallow recesses, with the apices of the ridges disposed substantially coplanar.

The finger pull preferably has a rectangular configuration with a length of the order of 2½" (6.35 cm.) such that all four fingers of a user's hand can engage one of the lengthwise extending finger contact edges 23*a*, with the user's fingernails extending into the recess behind the contact edge as shown in FIG. 4. The finger pull preferably has a width that is relatively small as compared to its length and such that, when the user's fingers are positioned in engagement with one of the contact edges of the pull to move the panel in one direction, the user's thumb can comfortably engage the finger contact edge at the other edge of the pull to control movement of the panel.

The mounting face 21 preferably extends to the ends 28 of the finger pull and has a width designated D in FIG. 5 that is preferably in the range of about ½" to ¾" (1.25 cm. to 2 cm.). The front face 22 is substantially wider than the rear mounting face and preferably at least about ⅜" (1 cm.) wider than the rear mounting face such that the fingernail receiving recesses extend inwardly from the finger contact edge 23*a* a distance indicated by the letter E in FIG. 5, which is preferably about 3/16" (0.5 cm.). The thickness or spacing of the front surface from the rear mounting face, indicated by the dimension A in FIG. 5, is preferably not substantially greater than 5/32"0.4 cm.) so that the outer panel of a pair of by-passing panels will normally bypass the finger pull mounted on the outer face of the inner panel. In order to maximize the front-to-rear depth of the fingernail receiving recesses, the side surfaces 23 are each formed with a first portion 23*b* that extends generally perpendicular to the plane of the rear mounting surface and a second portion 23*c* that extends generally parallel to the plane of the mounting surface, with a small fillet at the juncture between the surfaces 23*b* and 23*c*. Preferably, the thickness of the flange 24, indicated by the dimension C in FIG. 5, is about 3/64" (0.12 cm.) and the distance between the finger engaging edge and the mounting surface designated B in FIG. 5 is about 7/64" (0.28 cm.).

As previously described, the thickness dimension A of the finger pulls is selected such as to allow the outer panel to bypass a finger pull mounted on the face of the inner panel in normal operation. It has been found that when the finger pulls have a maximum thickness dimension of about 5/32" (0.4 cm.) that the outer panel will normally bypass a finger pull mounted on the inner panel, but can on occasion strike an edge of the finger pull on the inner panel. The abutment ribs 25 not only reinforce and strengthen the flanges 24 and the finger contact edges 23*a*, but also provide an abutment face 25*b* for engagement with the edge of a panel. This is of particular importance with very thin panels such as panels having a thickness of ⅛", which could, in the absence of the abutment ribs, enter the finger receiving space and possibly wedge the finger pull off the panel or fracture the panel if it is formed of a frangible material such as glass. The abutment ribs also have a face 25*a* generally coplanar with the mounting face 21 and which are adapted to engage the panel at locations laterally outwardly of the mounting face. It is considered that this aids in stabilizing the finger pull on the panel and inhibits tilting and peeling of the finger pull from the panel due to forces applied either by the user's fingers or to an impact force from a bypassing panel.

The front surface 22 of the finger pull can be formed with various different designs and patterns. In the embodiment illustrated, the front face is formed with a shallow recess 22*a* extending from end-to-end.

The embodiments of the invention in which an exclusive property or privilege is claimed are defined as follows:

1. A press-on type finger pull for application to the face of sliding panels comprising, a rigid body having a planar rear mounting surface and a front surface wider than the rear mounting surface and spaced from the plane of the rear mounting surface a distance not substantially greater than 0.4 cm., the body having first and second side surfaces extending forwardly and outwardly from the rear mounting surface and each defining a narrow finger contact edge adjacent the front surface and a fingernail receiving recess rearwardly of the finger contact edge, and at least one abutment rib extending transverse to each side surface, the abutment rib having a rear face generally coplanar with the mounting surface and an abutment face extending transverse to the plane of the mounting surface between the rear face and the finger contact edge on the associated side surface, and a thin layer of pressure sensitive adhesive on the rear mounting surface.

2. A press-on type finger pull according to claim 1 wherein an abutment rib extends transverse to each side surface adjacent each end of the body.

3. A press-on finger pull according to claim 1 wherein said side surfaces each include a first portion extending generally perpendicular to the plane of the mounting surface, a second portion extending outwardly from the first portion generally parallel to the plane of the mounting surface, and a third portion extending from the edge of the second portion to the face surface and defining said finger contact edge.

4. A press-on finger pull according to claim 3 wherein said second portion is spaced from the plane of the mounting surface approximately 0.28 cm.

5. A press-on finger pull according to claim 1 wherein the body is formed of synthetic resin material.

6. A press-on type finger pull according to claim 1 wherein the body has a generally rectangular configuration and the mounting surface has a width in the range of 1.25 cm. to 2 cm. and a length of in a range of 5 cm. to 7 cm.

7. A press-on type finger pull for application to the face of a panel comprising an elongated body including a central portion having a planar rear mounting surface and flange portions extending in opposite directions from the central portion adjacent a front side of the body and each providing a narrow finger contact edge spaced forwardly from the plane of the rear mounting surface and a fingernail receiving recess rearwardly of the finger contact edge, the body having a thickness in a range from 0.3 cm. to 0.4 cm., and an abutment rib extending transverse to flange portions adjacent opposite ends of the finger pull, the abutment ribs having a rear face generally coplanar with the mounting surface and an abutment face extending transverse to the plane of the mounting surface between the rear face and the finger contact edge, and a thin layer of pressure sensitive adhesive on the rear mounting surface.

8. A press-on finger pull according to claim 7 wherein flange portions are spaced from the plane of the mounting surface approximately 0.28 cm.

9. A press-on finger pull according to claim 7 wherein the body is formed of synthetic resin material.

10. A press-on type finger pull according to claim 7 wherein the body has a generally rectangular configuration and the mounting surface has a width in the range of 1.25 cm. to 2 cm. and a length of in a range of about 5 cm. to 7 cm.

* * * * *